US009039007B2

(12) United States Patent
Fukuda

(10) Patent No.: US 9,039,007 B2
(45) Date of Patent: May 26, 2015

(54) PAPER JOGGING APPARATUS

(71) Applicant: Mamoru Fukuda, Tokyo (JP)

(72) Inventor: Mamoru Fukuda, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/090,412

(22) Filed: Nov. 26, 2013

(65) Prior Publication Data

US 2014/0159302 A1 Jun. 12, 2014

(30) Foreign Application Priority Data

Dec. 5, 2012 (JP) ..... 2012-266396

(51) Int. Cl.

| | |
|---|---|
| ***B65H 31/26*** | (2006.01) |
| ***B65H 31/34*** | (2006.01) |
| ***B65H 31/38*** | (2006.01) |
| ***B65H 31/04*** | (2006.01) |

(52) U.S. Cl.

CPC ..... *B65H 31/34* (2013.01); *B65H 31/38* (2013.01); *B65H 2301/4222* (2013.01); *B65H 2301/4223* (2013.01); *B65H 2601/211* (2013.01); *B65H 2701/1315* (2013.01); *B65H 2801/48* (2013.01); *B65H 31/04* (2013.01); *B65H 31/26* (2013.01)

(58) Field of Classification Search

CPC ..... B65H 31/34; B65H 31/26; B65H 31/36; B65H 2301/4223

USPC ..... 271/220, 221, 207; 399/407, 410

See application file for complete search history.

(56) References Cited

U.S. PATENT DOCUMENTS

| | | | |
|---|---|---|---|
| 4,140,052 | A | 2/1979 | Meier |
| 2006/0290046 | A1 | 12/2006 | Sanmiya et al. |

FOREIGN PATENT DOCUMENTS

| | | | | |
|---|---|---|---|---|
| JP | 01075356 | A | * | 3/1989 |
| JP | H10-194555 | A | | 7/1998 |
| JP | 2012214278 | A | * | 11/2012 |
| WO | 2008/146842 | A1 | | 12/2008 |

OTHER PUBLICATIONS

Europe Patent Office, "Search Report for EP13275285.8," Mar. 25, 2014.

* cited by examiner

*Primary Examiner* — Luis A Gonzalez
(74) *Attorney, Agent, or Firm* — Manabu Kanesaka

(57) ABSTRACT

Sheets conveyed to a loading tray are stacked on the loading tray while they are sequentially aligned with an aligning unit, then, when pressing processing is performed with respect to a bundle of the stacked sheets, a presser is moved downward in a state where ends of the sheet bundle are abutting-held with the aligning unit. The sheet bundle is aligned by performing the pressing with a presser member gradually from a first reference fence side, to gradually discharge air staying in the sheet bundle from a first elastic body fence side.

9 Claims, 5 Drawing Sheets

PAPER JOGGING APPARATUS

RELATED APPLICATIONS

The present application is based on, and claims priority from, Japanese Application No. JP2012-266396 filed Dec. 5, 2012, the disclosure of which is hereby incorporated by reference herein in its entirety.

TECHNICAL FIELD

The present invention relates to a paper jogging apparatus, as a post-processing apparatus of a bookbinding machine or an image forming apparatus, for aligning a paper bundle of stacked plural paper sheets.

BACKGROUND ART

Conventionally, as a post-processing apparatus, connected to an image forming apparatus, for performing post-processing on plural print sheets printed with the image forming apparatus, a bookbinding machine which performs binding processing on a sheet bundle including printed text sheets with a book cover sheet to manufacture a book as a printed matter is widely used.

Further, as one bookbinding processing form in this type of bookbinding machine, so-called "case binding" of pasting a predetermined position (the back of the book) of a paper bundle of stacked plural sheets after image formation as text sheets, and covering up the pasted paper bundle with a cover sheet to attach the cover sheet to the paper bundle is known.

In the case binding, when pasting is performed in a state where the bundle of text sheets has curls and waviness, it is impossible to fully attaching the paste to the entire overlap part in the bundle of text sheets, and some text sheets may drop out of the cover sheet after the binding. Accordingly, an apparatus disclosed in Patent Literature 1 for performing bookbinding on a bundle of text sheets in an appropriate state is known.

A sheet bundle holding apparatus disclosed in Patent Literature 1 brings sheet-bundle posture correction members to correct curls and waviness of the sheet bundle into contact with an approximately central part of the sheet bundle while moving movable grip plates provided with the sheet bundle position correcting members. As a region where the sheet bundle position correcting members are in contact and pressed is gradually expanded outward by the approaching action of the movable grip plates with respect to the sheet bundle, it is possible to hold the sheet bundle while suppressing the curls and waviness.

CITATION LIST

Patent Literature

{Patent Literature 1} Japanese Published Unexamined Patent Application No. Hei 10-194555

SUMMARY OF INVENTION

Technical Problem

In the above-described apparatus, when the sheet bundle is clamped while the sheet shift due to curls and waviness of the sheet bundle is corrected, the sheet may be shifted in a horizontal direction by the contact between the sheet-bundle posture correction members and the sheet.

This apparatus is capable of correcting sheet shift in a vertical direction due to the curls and waviness of the text sheet bundle, although it does not have a function of correcting the sheet shift in the horizontal direction. Accordingly, the apparatus clamps the sheet bundle in the sheet-shifted state and proceeds to the next process, which causes missing pages.

The present invention has been made in consideration of the above situation, and provides a paper jogging apparatus capable of appropriate sheet alignment while suppressing sheet shift in a horizontal direction in addition to shift in a vertical direction due to curls and waviness, upon alignment of a bundle of plural sheets stacked on a tray.

Solution to Problem

According to one aspect of the present invention, there is provided a paper jogging apparatus in claim 1 including: a loading tray that receives conveyed sheets and loads them as a bundle of sheets; an aligning unit, having a pair of fence members to align ends of the sheets loaded on the loading tray, provided with an elastic body on a sheet abutting side surface in one fence member; a pressing unit provided along an aligning direction of the aligning unit, having a presser member to press the sheet bundle from one surface; a support unit, provided with an interval from the pressing member, that supports the other surface of the sheet bundle; and a controller that performs pressing with respect to the sheet bundle by narrowing the interval between the pressing unit and the support unit in a state where the aligning unit abutting-holds the sheet bundle, wherein the presser member, when not pressing the sheet bundle, is provided in an inclined state, with one end on the fence member side provided with the elastic body away from a sheet bundle pressing position farther than another end, and when the pressing against the sheet bundle is started, the presser member gradually moves from the inclined state into a state where the pressing member and the top surface of the sheet bundle are arranged on one plane, so as to press the sheet bundle.

Advantageous Effects of Invention

According to the paper jogging apparatus of the present invention, it is possible to correct sheet shift in a vertical direction due to curls and waviness occurred in a sheet bundle while preventing sheet shift in a horizontal direction by air staying between the sheets.

DESCRIPTION OF EMBODIMENTS

Hereinbelow, a preferred embodiment of the present invention will now be described in detail in accordance with the accompanying drawings. Further, the present invention is not limited to the following embodiment, and all other practicable embodiments and operational techniques and the like made by those skilled in the art based on the following embodiment are included in the scope of the present invention.

Figure 1:
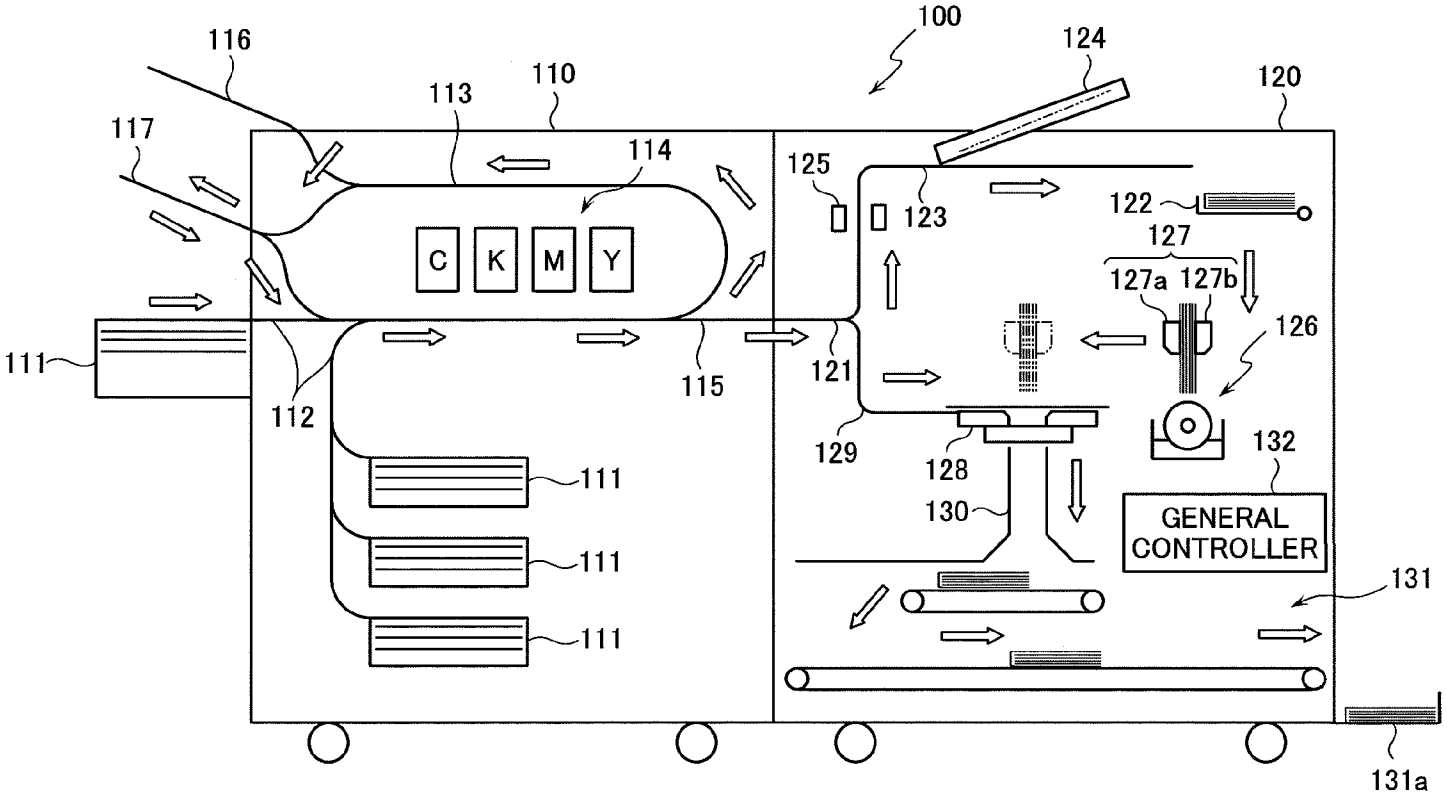
FIG. 1 A cross-sectional diagram schematically showing a bookbinding system in which a paper jogging apparatus according to the present invention is installed.

First, a bookbinding system in which a paper jogging apparatus of the present embodiment is installed will be described. As shown in FIG. 1, a bookbinding system 100 performs bookbinding processing with a bookbinding apparatus 120 on a cover sheet and text sheets printed with a printing apparatus 110, thus making a book as a printed matter.

Note that as specifications of the printing apparatus 110, an ink-jet printing apparatus is used in this embodiment. However, any of various image forming apparatuses such as a stencil printing apparatus, a copier and a laser beam printing apparatus may be employed as long as it is capable of desired image formation on the text sheets or the cover sheet.

The printing apparatus 110 performs printing on a cover sheet and text sheets and discharges them. The printing apparatus 110 has plural paper feed units 111 capable of containing plural types of sheets (paper sheets as text sheets and cover sheets) inside a cabinet accommodating respective units or on a side surface, a looped conveyance passage 113 for conveying sheets from an introduction passage 112, a printing unit 114 including four ink-jet heads C, K, M and Y to discharge cyan (C), black (k), magenta (M) and yellow (Y) inks, a first discharge passage 115 to discharge a printed sheet to the bookbinding apparatus 120, a second discharge passage 116 to discharge the sheet to the outside of the loop, and a switch-back passage 117 to receive the sheet conveyed through the conveyance passage 113 then reverse the sheet to the conveyance passage 113 so as to turn the sheet upside down.

The bookbinding apparatus 120 has an introduction conveyance passage 121 to introduce a printed cover sheet and text sheets conveyed from the printing apparatus 110, an aligning unit 122 to align the printed text sheets to form a sheet bundle, an upper bookbinding conveyance passage 123 to branched from the introduction conveyance passage 121, to convey the printed cover sheet and the text sheets to the side of the aligning unit 122, a stock tray 124 to temporarily stop the printed cover sheet, a sheet cutting unit 125 to cut the printed cover sheet into a size corresponding to the thickness of the sheet bundle, an adhesive coating unit 126 to coat an adhesive to a part of the rear surface and the side surface of the sheet bundle fed from the aligning unit 122, a pair of clamping units 127 including an upper clamp 127*a* and a lower clamp 127*b* movable vertically and horizontally while holding the sheet bundle in a stacking direction, a folding member 128 to fold the cover sheet by pressing the sheet bundle in the horizontal direction via the cover sheet in a state where the cover sheet is in contact with the rear surface of the adhesive-coated sheet bundle, a lower bookbinding conveyance passage 129 to convey the printed cover sheet fed from the upper bookbinding conveyance passage 123 to the folding member 128, a guide member 130 to guide a completed book made to fall from the folding member 128, a discharge unit 131 to discharge-convey the book that falls from the folding member 128 through the guide member 130 to a discharge tray 131*a*, and a general controller 132 (installed in the printing apparatus in the figure) to perform drive control on the respective units in the bookbinding system 100.

A paper jogging apparatus 1 of the present embodiment functions as the aligning unit 122 of the bookbinding apparatus 120 in the bookbinding system 100. The paper jogging apparatus 1 aligns the bundle of text sheets sequentially stacked on the aligning unit 122. The paper jogging apparatus 1 moves to the adhesive coating unit 126 while the aligned sheet bundle is clamped with the clamping units 127, then proceeds to pasting processing as the next process.

Next, the paper jogging apparatus 1 of the present embodiment will be described. As shown in any one of FIGS. 2A to 2C, FIG. 3 and FIG. 4, the paper jogging apparatus 1 functions as the aligning unit 122 of the above-described bookbinding apparatus 120. The paper jogging apparatus 1 sequentially stacks printed text sheets (hereinbelow simply "sheets") conveyed through the introduction conveyance passage 121 while aligning them by reciprocal slide action (jogger action), then perform press processing on a bundle of sheets the number of which has reached a predetermined number corresponding to a book to be made such that each end of the sheet bundle is jogged.

More specifically, the paper jogging apparatus 1 has a loading tray 2, an aligning unit 3, a presser 4, a support member 5 and a controller 6. Note that the controller 6 may be a specialized constituent for the present apparatus, or the above-described general controller 132 may have the function of the controller 6.

The loading tray 2 has a plate member with an approximately flat stacking surface 2*a* as its upper surface for loading the sheets conveyed from the introduction conveyance passage 121 while sequentially stacking them. Further, guide grooves 2*b* and 2*c* to regulate the sliding direction of the aligning unit 3 upon sheet alignment are formed in the stacking surface 2*a* of the loading tray 2.

The aligning unit 3 has a first aligning unit 3A having a pair of fence members to align an end in the widthwise direction of the sheet conveyed from the introduction conveyance passage 121 (hereinbelow, referred to as a "shorter side"), and a second aligning unit 3B having a pair of fence members to align an end in the sheet lengthwise direction orthogonal to the shorter side (hereinbelow, referred to as a "longer side"), provided to stand on the stacking surface 2*a* of the loading tray 2. Further, the first aligning unit 3A and the second aligning unit 3B are provided with a driving unit (driving motor or the like)(not shown) to reciprocally slide the respective members in a predetermined direction under the control of the controller 6.

Further, in the respective aligning units 3A and 3B, elastic bodies 3C (e.g. sponge or rubber members of synthetic resin or the like) for absorption of sheet size error and for appropriate alignment upon sheet alignment are provided in plural positions with spaces in between in parallel in the vertical direction in a sheet abutment surface of one of the fence members.

Note that in the present embodiment, a fence member not provided with the elastic bodies 3C will be referred to as a "reference fence (first reference fence 3Aa and a second reference fence 3Ba)", and a fence member provided with the elastic bodies 3C will be referred to as an "elastic body fence (first elastic body fence 3Ab and a second elastic body fence 3Bb)".

In this manner, since the elastic body 3C is provided respectively in one of the fence members in the first aligning unit 3A and the second aligning unit 3B, upon alignment of sheet bundle, the sheet size error can be absorbed with reference to the side of the first reference fence 3Aa and the second reference fence 3Ba without the elastic body 3C. Further, since a step part occurs between the elastic bodies 3C provided in the first elastic body fence 3Ab and the second elastic body fence 3Bb and the respective fence surfaces, it is possible, upon press processing with the presser 4, to release air between the sheets pushed out with the presser 4 from the step part.

The aligning unit 3 causes the first aligning unit 3A and the second aligning unit 3B to perform jogger action to align the conveyed sheets one by one in a position corresponding to the sheet size, under the control of the controller 6. Further, when a bundle of a predetermined number of sheets has been formed on the loading tray 2, the aligning unit 3 maintains the state of abutment between the first aligning unit 3A and the second aligning unit 3B and the respective ends of the sheet bundle until the press processing with the presser 4 is completed.

The first aligning unit 3A, having the pair of fence members (first reference fence 3Aa and first elastic body fence 3Ab) to slide along the guide groove 2*b* of the loading tray 2, aligns the sheet shorter side one by one in accordance with sheet loading timing with the jogger action for temporary alignment of sheets sequentially stacked on the loading tray 2. Further, when a bundle of the predetermined number of sheets is formed on the loading tray 2, the first aligning unit 3A maintains the state of abutment on the shorter side of the sheet bundle until the press processing with the presser 4 is completed.

The second aligning unit 3B, having the pair of fence members (the second reference fence 3Ba and the second elastic body fence 3Bb) to slide along the guide groove 2*c* of the loading tray 2, aligns the sheet longer side one by one in accordance with sheet loading timing with the jogger action for temporary alignment of the longer side of the sheets sequentially stacked on the loading tray 2. Further, when a bundle of predetermined number of sheets has been formed on the loading tray 2, the second aligning unit 3B maintains the state of abutment on the longer side of the sheet bundle until the press processing with the presser 4 is completed. Note that in the present embodiment, the second reference fence 3Ba is pivotally supported on the second elastic body fence 3Bb side so as not to disturb movement of the clamping units 127.

The presser 4 has a presser member 4*a*, which is a plate member (stainless steel plate) having a pressing surface to press the top surface of the sheet bundle on the loading tray 2 from above toward the sheet stacking direction, and a presser main body 4*b* to accommodate the presser member 4*a* upon pressing the sheet bundle. The presser 4 is provided above the top surface of the sheet bundle along the aligning direction of the first aligning unit 3A. The presser 4 moves downward from the top surface of the sheet bundle stacked on the loading tray 2, to gradually press the top surface of the sheet bundle with the pressing surface of the presser member 4*a*, under the control of the controller 6, thus performing final alignment processing prior to the next process by pressing the sheet bundle against the support member 5.

Further, the presser member 4*a* is provided in the presser main body 4*b*, with e.g. sponge members having different heights in the vertical direction at both ends, such that its one end on the first elastic body fence 3Ab side is inclined to the first reference fence 3Aa side positioned higher than the other end on the first reference fence 3Aa side, and after the completion of the press processing, the pressing surface and the top surface of the sheet bundle are arranged on one plane. That is, the presser member 4*a* is provided movably in the vertical direction with respect to the presser main body 4*b* with the end on the first elastic body fence 3Ab side as an origin, so as to be at a depression angle to the first reference fence 3Aa with the bottom surface of the presser main body 4*b* as a reference surface.

Upon press processing with the presser 4, the presser member 4*a*, initially in the inclined state, gradually presses the sheet bundle from the first reference fence 3Aa side toward the first elastic body fence 3Ab such that the top surface of the sheet bundle and the pressing surface are on one plane. Accordingly, the air staying between the sheets flows from the first reference fence 3Aa side to the first elastic body fence 3Ab side, and finally is discharged from the first elastic body fence 3Ab side.

Figure 2:
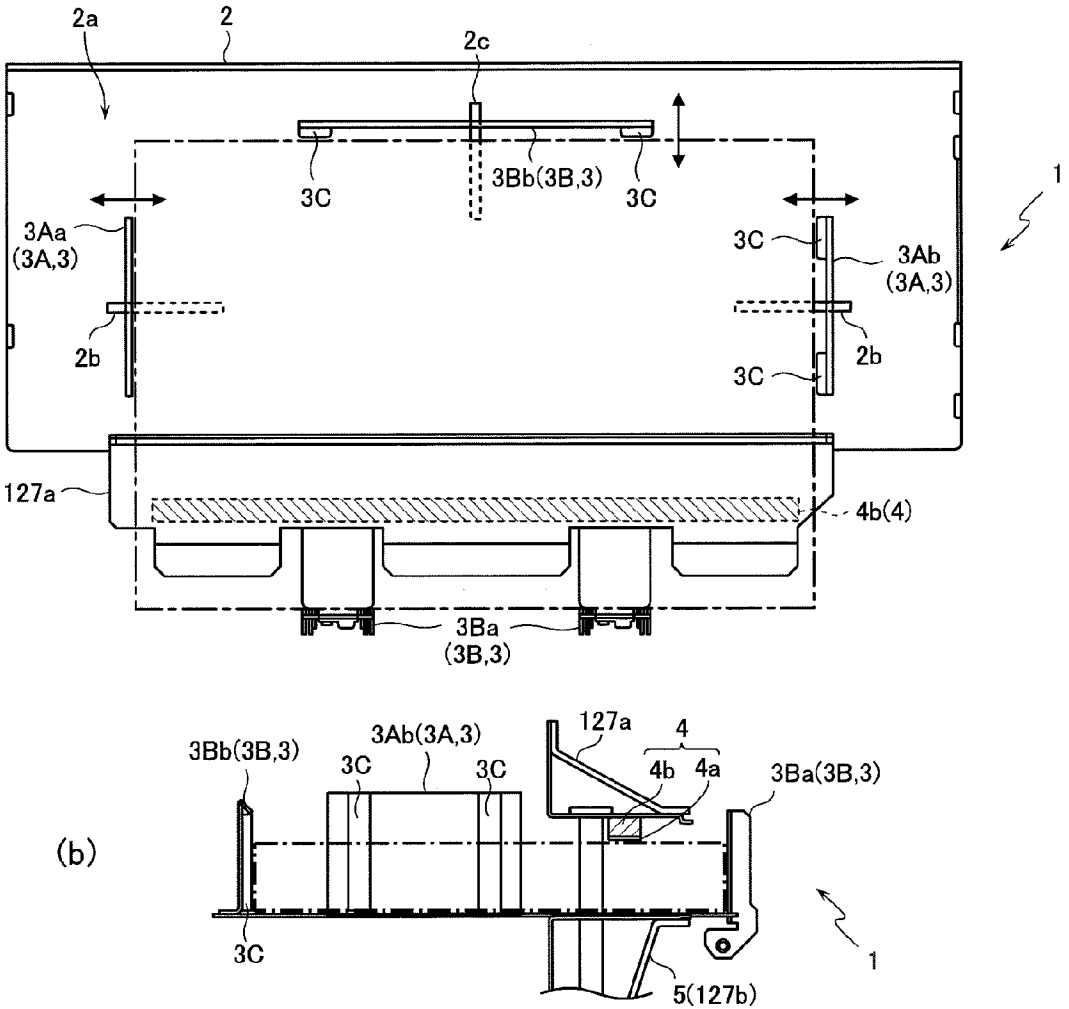
FIG. 2A is a top view of the paper jogging apparatus; 2B is a side view of the paper jogging apparatus.
Figure 3:
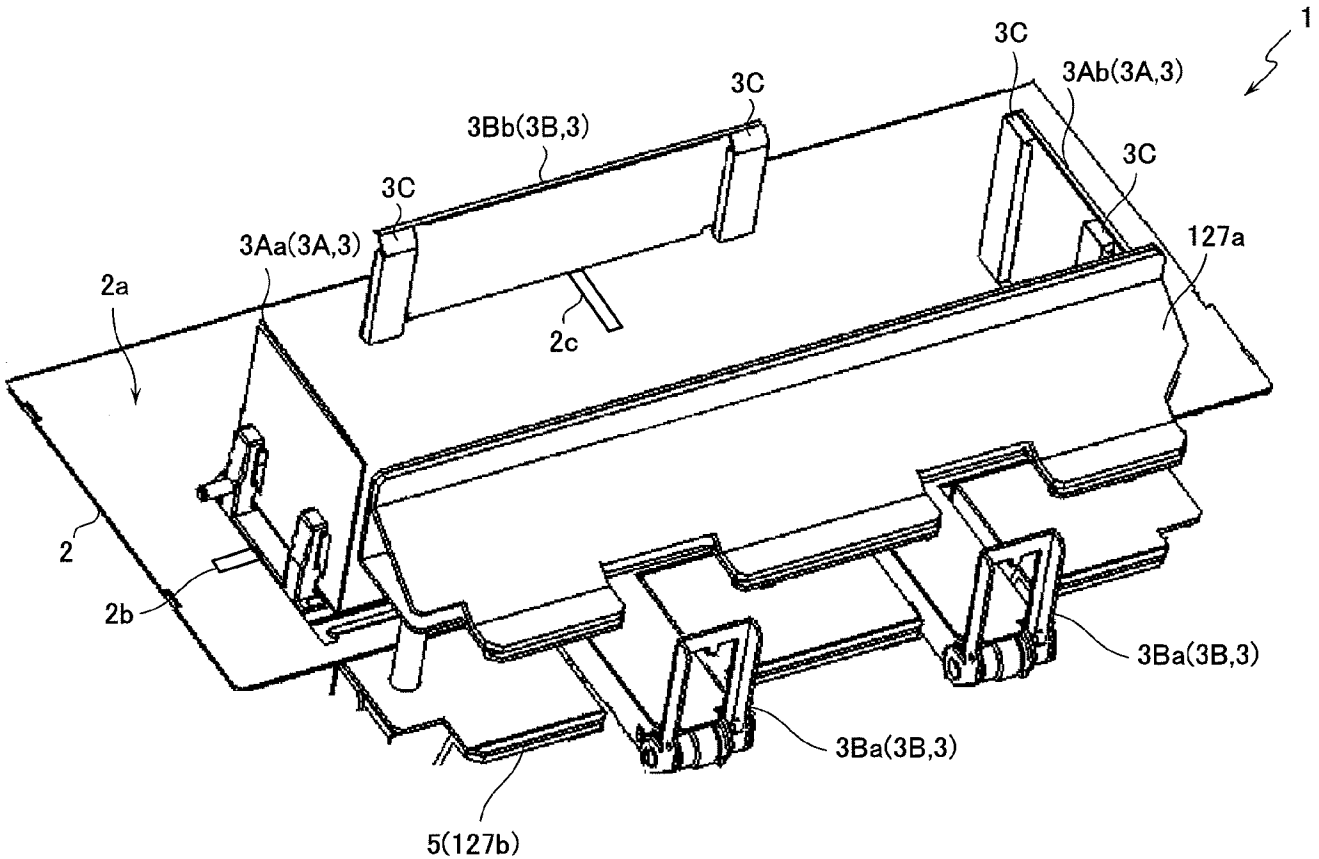
FIG. 3 A perspective diagram of the paper jogging apparatus.
Figure 4:
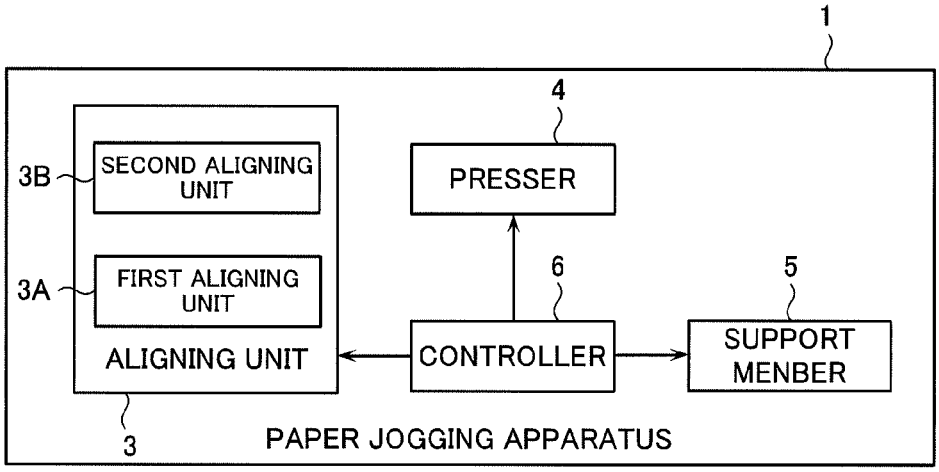
FIG. 4 A functional block diagram of the paper jogging apparatus.

Note that as shown in FIGS. 2A and 2B or FIG. 3, the presser 4 of the present embodiment has a length approximately the same as the longer side of the maximum size sheet loadable on the loading tray 2. In the present embodiment, the presser 4 is provided in the upper clamp 127*a* forming the clamping units 127, and the lower clamp 127*b* functions as the support member 5.

Next, the press processing with the presser 4 will be described with reference to FIGS. 5A to 5C.

Figure 5:
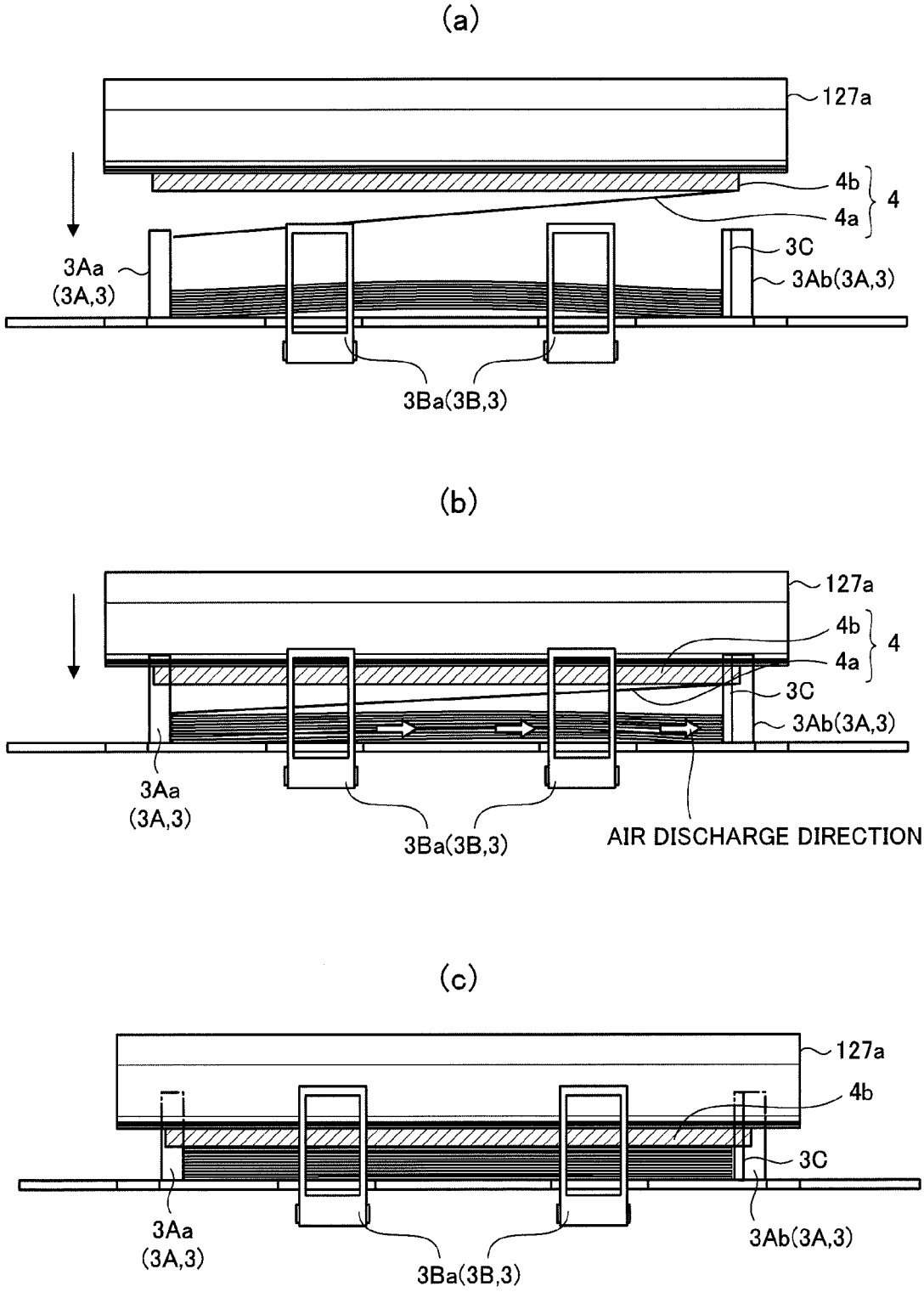
FIG. 5A to 5C are diagrams explaining an operation related to press processing in the paper jogging apparatus.

First, as shown in FIG. 5A, the sheets conveyed to the loading tray 2 are aligned one by one by the jogger action of the aligning unit 3, and when the bundle of a predetermined number of sheets has been stacked, the abutting state of the first aligning unit 3A and the second aligning unit 3B against the respective ends of the sheet bundle is maintained. At this time, since the first elastic body fence 3Ab and the second elastic body fence 3Bb abut against the ends of the sheet bundle with reference to the positions of the first reference fence 3Aa and the second reference fence 3Ba, the sheet size error is absorbed by the first elastic body fence 3Ab and the second elastic body fence 3Bb.

Next, as shown in FIG. 5B, the upper clamp 127*a* is moved downward while the lower clamp 127*b* as the support member 5 is fixed in a predetermined position, and the presser member 4*a* starts pressing of the top surface of the sheet bundle. With this operation, the pressing member 4*a* is gradually pressed from the first reference fence 3Aa side on the top surface of the sheet bundle, and the air staying between the sheets gradually flows from the first reference fence 3Aa side in an arrow direction in the figure to the first elastic body fence 3Ab side.

Then, as shown in FIG. 5C, when the presser 4 arrives at a final pressing position, all the air between the sheets is discharged from the first elastic body fence 3Ab side, and the sheet bundle is appropriately aligned.

The support member 5 moves to a predetermined support position under the control of the controller 6, and upon press processing with the presser 4, supports the sheet bundle pressed with the presser member 4*a*. In the present embodiment, the lower clamp 127*b*, forming the clamping units 127 to clamp the sheet bundle, performs the above function. In this manner, as the support member 5 supports the sheet bundle, it is possible to discharge the air staying in the sheet bundle pressed with the presser 4*a* upon press processing with the presser 4. Note that in an arrangement where the support member 5 is placed in a predetermined support position in advance, the control of the moving to the support position with the controller 6 may be omitted.

The controller 6 is e.g. a microcomputer having a CPU, a ROM, a RAM and the like. The controller 6 performs drive control on the aligning unit 3 in correspondence with sheet size of the sheet bundle in the book, drive control on the clamping units 127 regarding the press processing with the presser member 4*a* with respect to the sheet bundle in the alignment processing, abutment holding control on the aligning unit 3 with respect to the sheet bundle upon press processing, and in addition, performs drive control on the respective units of the paper jogging apparatus 1.

Next, a series of operations of the paper jogging apparatus 1 regarding the above-described alignment processing will be described. As described above, the paper jogging apparatus 1 of the present embodiment is installed as the aligning unit 122 of the bookbinding apparatus 120 to align printed text sheets. Here, an example of processing operation after the alignment by the press processing of the text sheets of a book to be made before the clamped sheet bundle moves to the next pasting process will be described.

First, when sheet size information on the text sheets of the book to be made is inputted, the first aligning unit 3A and the second aligning unit 3B are placed in standby state in positions a little wider than the sheet size. Next, when the sheets are conveyed onto the loading tray 2, respective sheet ends are temporarily aligned one by one by jogger action until the number of sheets reaches the predetermined number. When the number of the sheets of the bundle has reached the predetermined number, the process proceeds to the press processing while the state where the aligning unit 3 abuts on the respective ends of the sheet bundle is maintained.

In the press processing, the upper clamp 127*a* is moved downward from the first reference fence 3Aa side of the top surface of the abut-held sheet bundle while the lower clamp 127*b* as the support member 5 is fixed to the predetermined position, and the presser member 4*a* starts to press the top surface of the sheet bundle. At this time, the sheet bundle pressed with the presser member 4*a* is gradually pressed from the first reference fence 3Aa side of the top surface of the sheet bundle, and the air staying between the sheets gradually flows from the first reference fence 3Aa side to the first elastic body fence 3Ab side.

Then, when the presser 4 arrives at the final pressing position, the air between the sheets of the sheet bundle in the part pressed with the presser 4 is discharged from the first elastic body fence 3Ab side. Thereafter, the sheet bundle clamped with the clamping units 127 is conveyed to the adhesive coating unit 126, then the process proceeds to the next pasting processing.

As described above, in the paper jogging apparatus 1, the sheets conveyed to the loading tray 2 are stacked while they are sequentially aligned with the aligning unit 3, and when the sheet bundle is subject to the press processing, the presser 4 is moved downward while the ends of the sheet bundle are in abutting contact with the aligning unit 3, to press the sheet bundle against the sheet stacking surface 2*a* from the sheet bundle top surface side.

The presser member 4*a* is provided in the presser main body 4*b* such that one end on the first elastic body fence side 3Ab is inclined to the first reference fence 3Aa side positioned higher than the other end of the first reference fence side 3Aa, and after the completion of the press processing, the pressing surface and the top surface of the sheet bundle are arranged on one plane. Accordingly, at this time, the air staying in the sheet bundle gradually flows from the first reference fence 3Aa side to the first elastic body fence 3Ab side, and the air is finally discharged from the step part between the elastic body and the fence main body occurred in the first elastic body fence 3Ab.

With this arrangement, it is possible to correct sheet shift in the vertical direction due to curls and waviness occurred in sheets of the sheet bundle while preventing sheet shift with respect to the horizontal direction due to air staying between the sheets. Accordingly, when the present apparatus is employed as an aligning unit for text sheet aligning in the bookbinding apparatus 120, it is possible to prevent product defects such as missing pages which occur when the sheet bundle is clamped with shifted text sheets and the process proceeds to pasting process.

Other Embodiments

Note that the present invention is not limited to the above-described embodiment, and may be arbitrarily changed and implemented in accordance with environment as described below. Further, the following modifications may be arbitrarily combined and implemented within a scope not departing from the subject matter of the present invention.

In the above-described embodiment, the aligning unit 3 has two aligning units, i.e., the first aligning unit 3A to align the longer side of the sheet bundle and the second aligning unit 3B to align the shorter side of the sheet bundle. However, the present invention is not limited to this arrangement, and the aligning unit 3 may be arranged such that it aligns only one of the ends of the sheet bundle in accordance with application, i.e., the aligning unit 3 has the first aligning unit 3A or the second aligning unit 3B. At this time, the presser 4 is provided above the sheet bundle stacked on the loading tray 2 and along the aligning direction of the aligning unit 3.

Further, in the present embodiment, the presser 4 is provided in the upper clamp 127*a* of the clamping units 127 and the support member 5 functions as the lower clamp, such that the clamp processing and the press processing with respect to the sheet bundle are simultaneously performed. However, the present invention is not limited to this arrangement. For example, to perform the press processing with the presser 4 and the support member 5 with respect to the sheet bundle, it may be arranged as a drive mechanism specialized for pressing, such that the presser 4 is moved in the vertical direction (sheet stacking direction) while the support member 5 in the form of a plate member is placed in a standby state in a predetermined position.

Further, in the above description, the paper jogging apparatus 1 of the present embodiment is installed as an aligning unit of the bookbinding apparatus 120. However, the present invention is not limited to this example. For application of the present apparatus, for example, the apparatus may be installed as a sheet aligning unit of a staple apparatus to perform stapling processing on the bundle of a predetermined number of sheets printed with the printing apparatus 110, or the apparatus may be connected to the subsequent stage of the printing apparatus 110 simply for alignment of printed sheets.

REFERENCE SIGNS LISTS

1. paper jogging apparatus
2. loading tray
3. aligning unit
3A. first aligning unit (3Aa. first reference fence, 3Ab. first elastic body fence)
3B. second aligning unit (3Ba. second reference fence, 3Bb. second elastic body fence)
3C. elastic body
4. presser (4*a*. presser member, 4*b*. presser main body)
5. support member
6. controller
120. bookbinding apparatus
122. aligning unit
127. clamping units (127*a*. upper clamp, 127*b*. lower clamp)

The invention claimed is:

1. A paper jogging apparatus comprising:

a loading tray that receives sheets and loads the sheets as a bundle of sheets;

an aligning unit aligning side ends of the bundle of sheets loaded on the loading tray, and including a first elastic body fence having a first sheet abutting side and a first elastic body formed on the first sheet abutting side to align one side end of the bundle of sheets, and a first reference fence facing the first elastic body fence to align another side end of the bundle of sheets and having no elastic body;

a pressing unit pressing the bundle of sheets from one surface thereof, and having a presser main body extending in a direction from the first elastic body fence toward the first reference fence and a presser member having one end swingably attached to a lower surface of the presser main body adjacent to the first elastic body fence and extending from one end of the presser main body toward another end thereof while passing under the lower surface of the presser main body;

a support unit situated under the pressing member to form an interval therebetween and supporting another surface of the bundle of sheets; and a controller that performs pressing with respect to the bundle of sheets by moving the pressing unit in a direction narrowing the interval between the pressing unit and the support unit in a state where the aligning unit abutting-holds the bundle of sheets, wherein when the presser member does not press the bundle of sheets, the presser member is inclined such that the one end of the presser member adjacent to the first elastic body fence is positioned away from a position of pressing the bundle of sheets more than another end of the presser member adjacent to the first reference fence, and when the presser member presses the bundle of sheets, the another end of the presser member gradually moves upwardly to completely abut on an upper surface of the bundle of sheets, thereby pressing the bundle of sheets.

2. A paper jogging apparatus according to claim 1, wherein the first elastic body vertically extends away from the first sheet abutting side to form a step part, and when the presser member presses the bundle of sheets, the presser member abuts the bundle of sheets in a direction from the another end of the presser member to the one end thereof to release air between the sheets pushed with the presser member through the step part.

3. A paper jogging apparatus according to claim 2, wherein the aligning unit further includes a second elastic body fence arranged perpendicular to the first elastic body fence and having a second sheet abutting side and a second elastic body formed on the second sheet abutting side, and a second reference fence facing the second elastic body fence and having no elastic body; and the first elastic body fence and the first reference fence align the side ends of the bundle of sheets and the second elastic body fence and the second reference fence align other side ends of the bundle of sheets.

4. A paper jogging apparatus according to claim 1, further comprising a clamping unit arranged adjacent to the aligning unit, and including an upper clamp vertically movably arranged above the bundle of sheets and having a lower plate portion, wherein the pressing unit is arranged at a side apart from the aligning unit on the lower plate portion.

5. A paper jogging apparatus according to claim 4, wherein the clamping unit further includes a lower clamp facing the upper clamp and formed as the support unit, and support portions formed on each side end of the lower plate portion and connecting the lower plate portion and the lower clamp; and the upper clamp moves in a direction abutting on the upper surface of the bundle of sheets through the support portions.

6. A paper jogging apparatus comprising:

a loading tray receiving sheets and loading the sheets as a bundle of sheets;

an aligning unit aligning ends of the bundle of sheets loaded on the loading tray, and including an elastic body fence having a sheet abutting side and a plurality of elastic bodies formed on the sheet abutting side to align one end of the bundle of sheets, the plurality of elastic bodies vertically extending to be spaced from the sheet abutting side to form a step part and being spaced from each other in a direction parallel to the one end of the bundle of sheets, and a reference fence facing the elastic body fence to align another end of the bundle of sheets and having no elastic body;

a pressing unit provided along an aligning direction of the aligning unit and having a presser member to press the bundle of sheets from one surface thereof;

a support unit situated under the pressing member to form an interval therebetween and supporting another surface of the bundle of sheets; and a controller that performs pressing with respect to the bundle of sheets by moving the pressing unit in a direction narrowing the interval between the pressing unit and the support unit in a state where the aligning unit abutting-holds the bundle of sheets, wherein when the presser member does not press the bundle of sheets, the presser member is inclined such that one end of the presser member adjacent to the elastic body fence is positioned away from a position of pressing the bundle of sheets more than another end of the presser member, and when the presser member presses the bundle of sheets, the another end of the presser member gradually moves upwardly to completely abut on an upper surface of the bundle of sheets, thereby pressing the bundle of sheets to release air between the sheets pushed with the presser member through the step part.

7. A paper jogging apparatus according to claim 6, wherein the pressing unit includes a presser main body extending in a direction from the elastic body fence toward the reference fence, and the presser member having one end swingably attached to a lower surface of the presser main body adjacent to the elastic body fence and extending from one end of the presser main body toward another end thereof passing under the lower surface of the presser main body.

8. A paper jogging apparatus comprising:

a loading tray receiving sheets and loading the sheets as a bundle of sheets;

an aligning unit aligning ends of the bundle of sheets loaded on the loading tray, and including an elastic body fence having a sheet abutting side and a plurality of elastic bodies formed on the sheet abutting side to align one end of the bundle of sheets, the plurality of elastic bodies vertically extending to be spaced from the sheet abutting side to form a step part and being spaced from each other in a direction parallel to the one end of the bundle of sheets, and a reference fence facing the elastic body fence to align another end of the bundle of sheets and having no elastic body;

a pressing unit extending in a direction from the elastic body fence toward the reference fence and having a presser member to press the sheet bundle from one surface thereof;

a support unit situated under the pressing member to form an interval therebetween and supporting another surface of the bundle of sheets; and a controller that performs pressing with respect to the bundle of sheets by moving the pressing unit in a direction narrowing the interval between the pressing unit and the support unit in a state where the aligning unit abutting-holds the bundle of sheets, wherein when the presser member does not press the bundle of sheets, the presser member is inclined such that one end of the presser member adjacent to the elastic body fence is positioned away from a position of pressing the bundle of sheets more than another end of the presser member, and when the presser member presses the bundle of sheets, the another end of the presser member gradually moves upwardly to completely abut on an upper surface of the bundle of sheets in a direction from the another end of the presser member to the one end thereof, thereby pressing the bundle of sheets to release air between the sheets pushed with the presser member through the step part.

9. A paper jogging apparatus according to claim 8, wherein the pressing unit includes a presser main body extending in the direction from the elastic body fence toward the reference fence, and the presser member having one end swingably attached to a lower surface of the presser main body adjacent to the elastic body fence and extending from one end of the presser main body toward another end thereof while passing under the lower surface of the presser main body.

* * * * *